United States Patent [19]

Malm

[11] Patent Number: 4,653,154

[45] Date of Patent: Mar. 31, 1987

[54] CAP AND CLIP ASSEMBLY FOR INSTRUMENT

[75] Inventor: Curtis L. Malm, Quincy, Mass.

[73] Assignee: The Gillette Company, Boston, Mass.

[21] Appl. No.: 305,960

[22] Filed: Sep. 28, 1981

[51] Int. Cl.[4] ..... B43K 25/00; B43K 9/00

[52] U.S. Cl. ..... 24/11 R; 24/11 F; 401/131; 401/243

[58] Field of Search ..... 24/10 R, 11; 401/98, 401/213, 243-247, 131, 102, 91

[56] References Cited

U.S. PATENT DOCUMENTS

| | | | |
|---|---|---|---|
| D. 261,010 | 9/1981 | Itoh . | |
| 1,450,162 | 3/1923 | Livsey | 24/11 F |
| 2,939,426 | 6/1960 | Rodenhauser et al. | 120/421 |
| 3,156,960 | 11/1964 | Klitzner | 24/11 F |
| 3,224,053 | 12/1965 | Jenkins | 24/11 |
| 3,608,154 | 9/1971 | Ira | 24/11 F |

FOREIGN PATENT DOCUMENTS

| | | | |
|---|---|---|---|
| 376692 | 8/1921 | Fed. Rep. of Germany | 24/11 F |
| 2136192 | 2/1973 | Fed. Rep. of Germany | 24/11 R |
| 1428677 | 1/1966 | France | 24/11 F |
| 256244 | 8/1948 | Switzerland | 24/11 F |

*Primary Examiner*—Steven A. Bratlie
*Attorney, Agent, or Firm*—John P. Morley

[57] ABSTRACT

A cap and clip assembly for an instrument having working means at one end, the assembly being adapted to cover the working means when the working means is not in use, the assembly including a cap member having an open end, a housing extending from the cap member proximate the open end and including a slot having an opening facing in the same direction as the open end of the cap member, and an elongated clip member having a substantially flat base portion, the cap member slot being adapted to receive and retain the base portion of the clip member.

2 Claims, 7 Drawing Figures

CAP AND CLIP ASSEMBLY FOR INSTRUMENT

BACKGROUND OF THE INVENTION

1. Field of The Invention

This invention relates to cover means for instruments, and is directed more particularly to a cap and clip assembly for an instrument having working means at one end, the assembly being adapted to cover the working means when the working means is not in use, including such instruments as writing instruments, thermometers, pressure gauges, and the like.

2. Description of the Prior Art

Cap and clip assemblies are well known in the art and usually include a cap member with a clip member fixed thereto. In most instances, the clip member is provided with a ring which is fitted around the cap member, and in other instances the clip member is staked, or stapled, to the cap member. Use of the ring places appearance limitations on the assembly and staking often leads to breakage and/or an insecure connection.

SUMMARY OF THE INVENTION

It is, therefore, an object of the invention to provide a cap and clip assembly in which neither a ring nor staking is required.

A further object of the invention is to provide such an assembly in which the interconnection of the cap and clip portions adds to, rather than detracts from the appearance of the assembly.

With the above and other objects in view, as will hereinafter appear, a feature of the present invention is the provision of a cap and clip assembly for an instrument having working means at one end, the assembly being adapted to cover the working means when the working means is not in use, the assembly including a cap member having an open end, a housing extending from the cap member proximate the open end and including a slot having an opening facing in the same direction as the open end of the cap member, and an elongated clip member having a substantially flat base portion, the cap member slot being adapted to receive and retain the base portion of the clip member.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
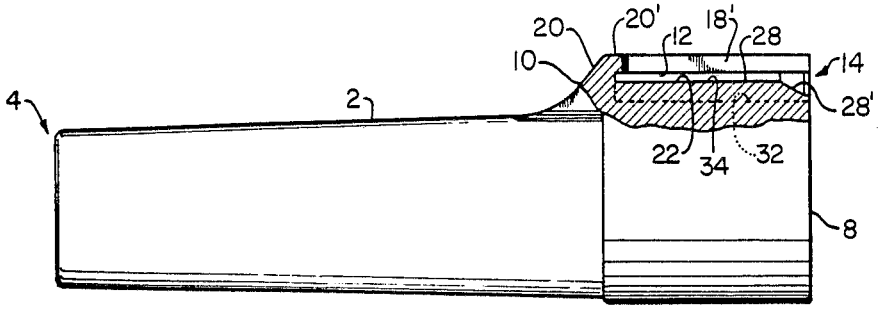
FIG. 1 is a side elevational view, partly broken away, of a cap portion of one form of assembly.
Figure 2:
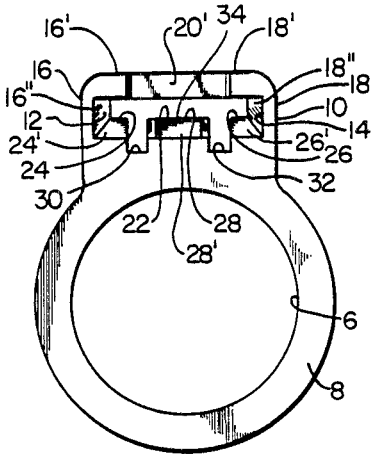
FIG. 2 is an end elevational view of the cap portion of FIG. 1.
Figure 3:
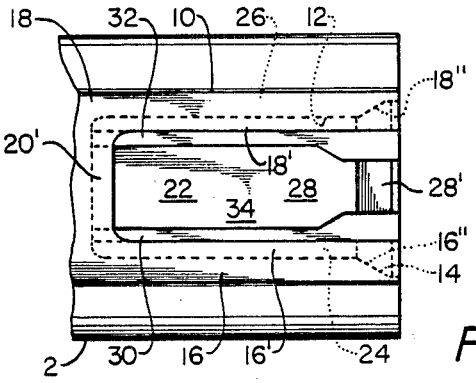
FIG. 3 is a top elevational view of a portion of the cap of FIG. 1.

Referring to FIGS. 1–3, it will be seen that an illustrative cap member comprises a substantially tubular member 2 closed at a first end 4 thereof and provided with an opening 6 at a second end 8 thereof.

A housing 10 extends from the cap member 2 proximate the second end 8 thereof and includes a slot 12 having an opening 14 facing in the same direction as the opening 6 of the cap member second end 8. The housing 10 comprises first and second upstanding side walls 16, 18 and a back wall 20. The side walls and back wall are each provided at their free ends with inwardly directed flange portions 16', 18', 20'. The housing 10 is provided with a floor 22 including side portions 24, 26 and a central portion 28, the central portion 28 being separated from the side portions 24, 26 by recesses 30, 32. The central portion 28 is provided with a planar surface 34. Adjacent the opening 14, the side walls 16, 18 are provided with flaired portions 16'', 18'' and the floor portions 24, 26, 28 are provided with flaired portions 24', 26' and 28', respectively.

Figure 4:
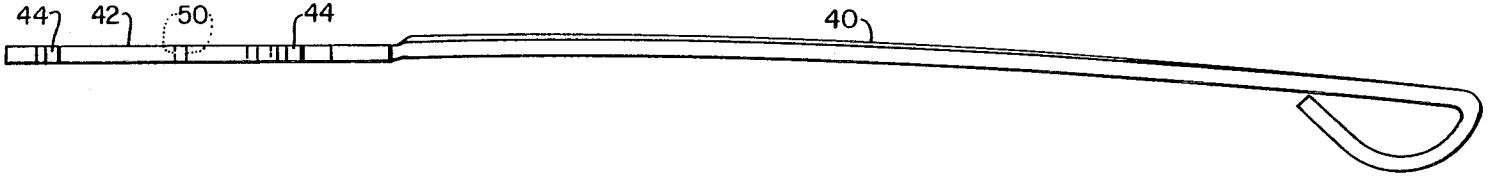
FIG. 4 is a side elevational view of a clip portion of the assembly.
Figure 5:
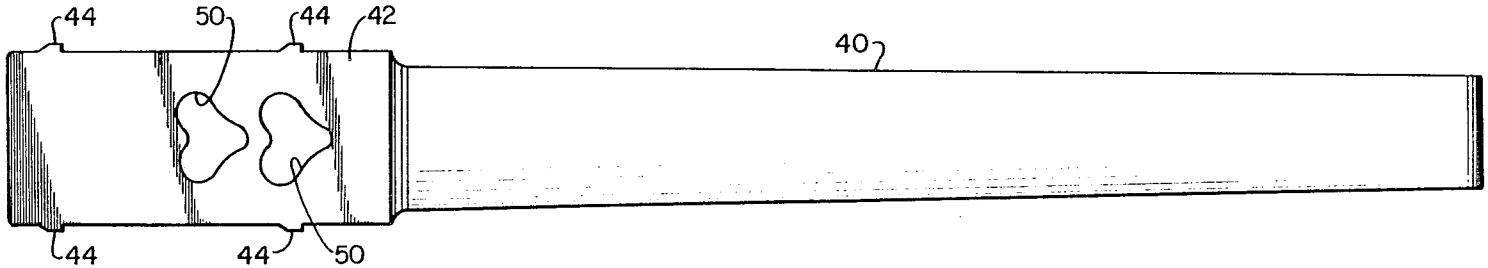
FIG. 5 is a front elevational view of the clip portion of FIG. 4.

In FIGS. 4 and 5 there is shown an illustrative clip member 40 for use in the assembly, the clip member 40 including a substantially flat base portion 42. The base portion 42 is provided on either side thereof with outwardly extending lugs 44. The size of the base portion 42 is generally equal to the size of the cap member slot 12.

Figure 6:
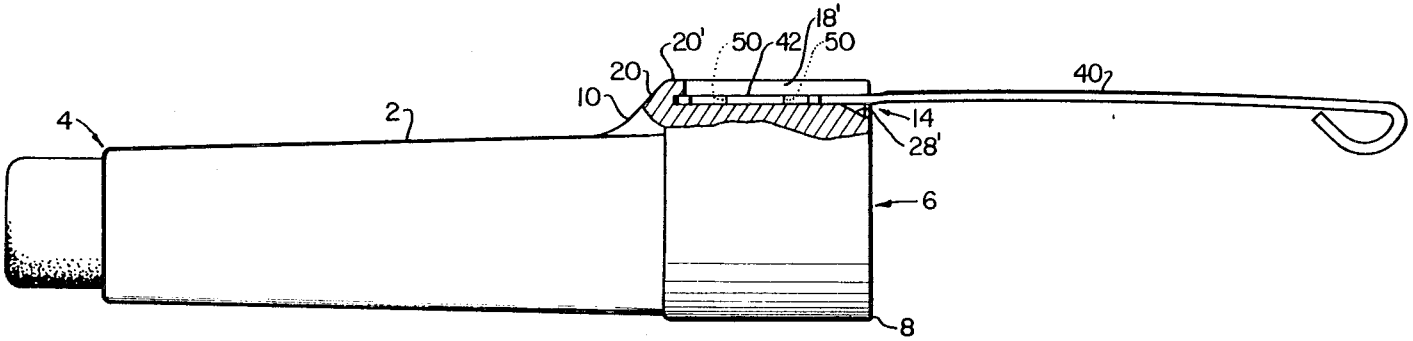
FIG. 6 is a side elevational view, partly broken away, of one form of assembly illustrative of an embodiment of the invention, utilizing the cap portion of FIGS. 1–3 and the clip portion of FIGS. 4 and 5.

In assembly, the base portion 42 of clip member 40, which is preferably of metal construction, is forced into the opening 14 of the cap member housing slot 12, the flaired portions 16'', 18'', 24', 26' and 28' serving to guide the clip base portion into the slot 12. The cap member 2 is preferably of plastic construction and deforms sufficiently to permit the base portion lugs 44 to move along the side walls 16, 18 until the clip base portion 42 is snugly nestled in the slot 12 (FIG. 6) at which time the plastic walls rebound to envelope the lugs 44 and firmly retain the clip 40 in the housing 10.

The base portion 42 of the clip member is framed by the flanges 16', 18' and 20'. In a preferred embodiment, the base portion is provided with a hole or holes 50 therein of a selected design, the holes permitting the texture and color of the housing floor central portion 28 to show therethrough, presenting a pleasing appearance and facilitating the incorporation of a design or logo in the clip without the need of paint or imprint on the clip.

Thus, the present assembly affords a simple and inexpensive construction and an interconnection of cap and clip which is secure and attractive in appearance.

Figure 7:
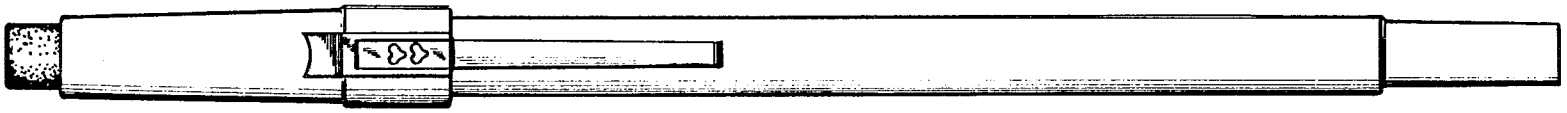
FIG. 7 is a front elevational view of the assembly of FIG. 6 mounted on an instrument, the cap covering a working end of the instrument.

In FIG. 7, the assembly is shown in conjunction with an elongated instrument, as for example, a writing instrument.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. Cap and clip assembly for an instrument having working means at one end thereof, said assembly being adapted to cover said working means when said working means is not in use, said assembly comprising a cap member having a closed first end and an open second end, an elongated clip member having a substantially flat base portion, and a housing extending from said cap member proximate said second end, said housing including a slot having an opening facing in the same direction as the opening of said cap member second end, and said cap member housing slot being adapted to receive and retain said base portion of said clip member, said housing further including a floor portion, upstanding side walls and an upstanding back wall, said side and back walls having at their free ends inwardly directed flanges overlying said base portion of said clip member.

2. The invention in accordance with claim 1 in which said base portion is provided with a hole therethrough exposing said floor portion to view through said base portion.

* * * * *